United States Patent [19]

Keigher

[11] Patent Number: 4,531,613

[45] Date of Patent: Jul. 30, 1985

[54] FIREFIGHTER'S LADDER

[76] Inventor: William T. Keigher, 313 Fairlane Dr., Joliet, Ill. 60435

[21] Appl. No.: 603,252

[22] Filed: Apr. 23, 1984

[51] Int. Cl.[3] ..... E06C 7/48; E06C 1/08

[52] U.S. Cl. ..... 182/206; 182/45; 182/163

[58] Field of Search ..... 182/206, 129, 45, 93

[56] References Cited

U.S. PATENT DOCUMENTS 1,205,594 11/1916 Close ..... 182/206

4,279,327 7/1981 Warren ..... 182/206

*Primary Examiner*—Reinaldo P. Machado

*Attorney, Agent, or Firm*—Ernest Kettelson

[57] ABSTRACT

A ladder for firefighters having spread apart upper rails to provide clearance and a working space for them to chop an opening in the roof of a burning house to enable smoke to escape and otherwise aid in eventually extinguishing the fire. The ladder includes a pair of side rails spaced apart the normal distance as in conventional ladders, but the upper portion of each side rail includes two hinged sections, the first hinged to swing outwardly to a position at a right angle to the lower portion of its respective side rail, the second hinged to swing upwardly to a position at a right angle to the first hinged section to which the second hinged section is pivotally connected by a hinge member. Pins or other lock means are provided to hold the hinged sections in the spread apart working position of the ladder. The upper free end of each second hinged section of each side rail includes a hook to hook over the peak of the roof, the ladder lying against the pitched side of the roof. A conventional extension ladder is used to reach the roof by the firefighter who carries the ladder in accordance with this invention up to the roof, pushing it up until the spread apart second hinged sections of the side rails having the hooks at their free ends reaches the peak of the roof for the hooks to engage and hold the ladder securely in place. The firefighter then steps on to the rungs of the lower section of the ladder in accordance with this invention, and climbs to the area of the spread apart hinged sections which provide a wide space for him to work to make a hole through the roof. Such hole in accordance with good firefighting practice should be about three feet by five feet. The spread apart hinged sections should have lengths which will provide a clearance space between them when spaced apart of approximately four feet by six feet.

14 Claims, 13 Drawing Figures

FIREFIGHTER'S LADDER

BACKGROUND OF THE INVENTION

This invention relates to the field of ladders for use primarily by firefighters, and in particular to that portion of the field which pertains to ladders used on pitched roof of buildings wherein a working space between the side rails is needed to perform a particular task, such as cutting a hole of a preferred size through the roof of a burning building.

Ladders presently used for this purpose are of the conventional type, having completely rigid and fixed side rails which are spaced apart substantially the same distance throughout the length of the ladder. The upper portion of the ladder is therefore relatively narrow with very little space between the rails for a firefighter to work with an axe in order to chop a hole through the roof of the burning building. To make a hole of the recommended size, which should be about three by five feet in accordance with good firefighting practice, it is necessary for the firefighter on a conventional ladder to reach to one or both sides of the ladder to widen the hole sufficiently to reach the recommended size. This can be awkward as well as dangerous.

The present invention solves this problem by providing a ladder whose upper rail portion includes two hinged sections of each side rail, the first hinged sections being pivotable outwardly from their respective lower side rail portions, the second hinged section then being pivotable upwardly, thereby providing a widened space between the upper portion of the side rails. The firefighter can more easily use his axe to chop a hole of the desired size in the roof of the burning building between the spread apart upper portion of the ladder in accordance with this invention. The upper free ends of the second hinged sections include hooks to hook over the peak of the roof, or other convenient anchor place for the hooks to hook on to and hold the ladder in place on the pitched roof.

The upper free ends of the second hinged sections also include anchor bolts to secure respective ends of a rope used as a lifeline by the firefighter, who has such rope secured to himself to prevent a fall in the event he should slip off of the ladder. The first hinged sections extend outwardly from their respective lower side rail portions at a ninety degree angle to thereby provide a substantially horizontal platform for the firefighter to stand on as he works to make the desired hole through the roof. These horizontally extending hinged sections may each have a second length of rail extending parallel thereto and connected by hinge members whereby these second lengths of rail may be pivoted from a one-over-the-other position to a side-by-side position thereby providing a wider platform for the firefighter to stand on.

SUMMARY OF THE INVENTION

It is an object of the invention to provide a ladder having an upper section whose side rails are substantially farther apart than those of its lower section.

It is an object of the invention to provide a ladder having side rails in which the upper portion of each side rail includes first and second hinged sections, the first hinged sections of each side rail being pivotable outwardly from the lower portions of their respective side rails to a substantially right angle position thereto and securable in such position, the second hinged sections of each side rail being pivotable upwardly from their respective first hinged sections to a substantially right angle position thereto and securable in such position, thereby providing a wide clearance space between the upper portion of the side rails for a workman to work between such side rails eliminating the dange of having to reach outwardly from one side of the ladder to the other in order to do such work.

DESRIPTION OF PREFERRED EMBODIMENT

Figure 1:
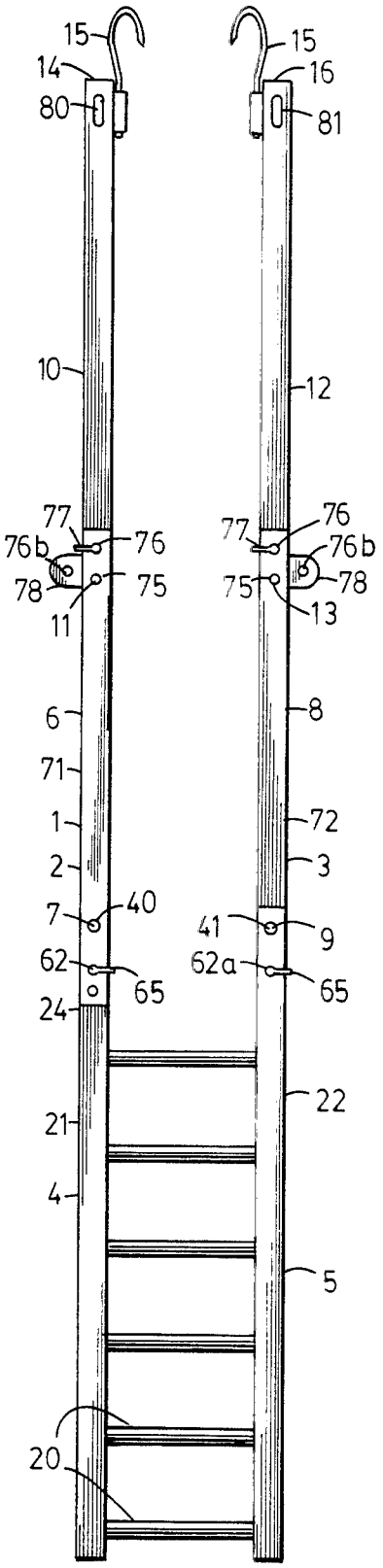
FIG. 1 is a front elevation view of the ladder in accordance with this invention shown in its in-line position.
Figure 2:
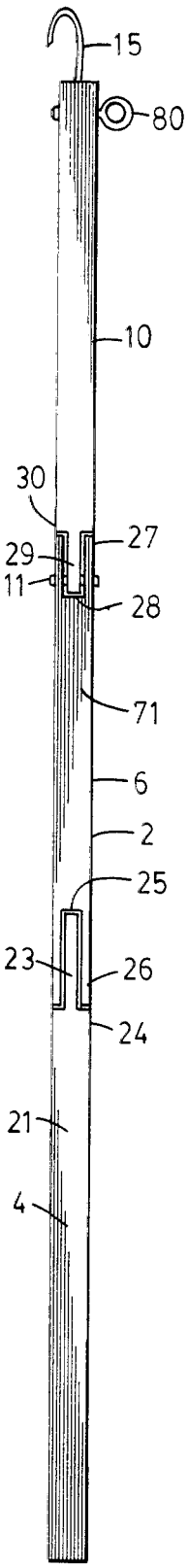
FIG. 2 is a side elevation view from the left of the ladder shown in FIG. 1.
Figure 3:
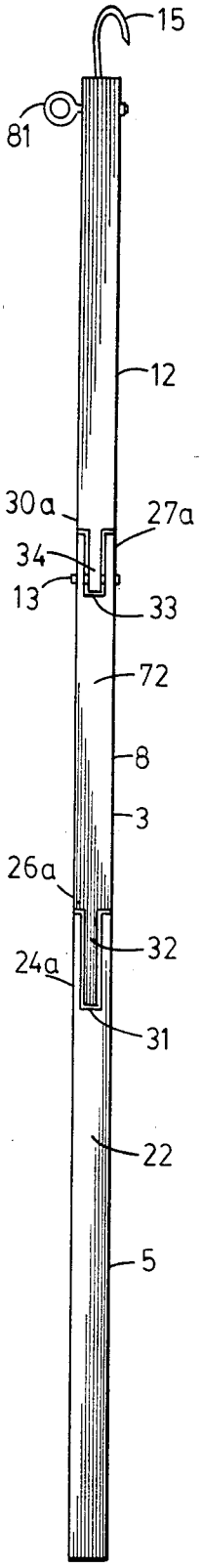
FIG. 3 is a side elevation view from the right of the ladder shown in FIG. 1.
Figure 4:
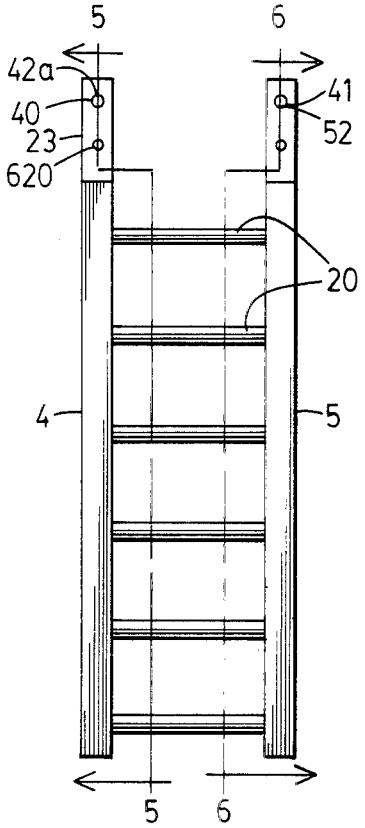
FIG. 4 is a front elevation view of the bottom section of the ladder in accordance with this invention.
Figure 5:
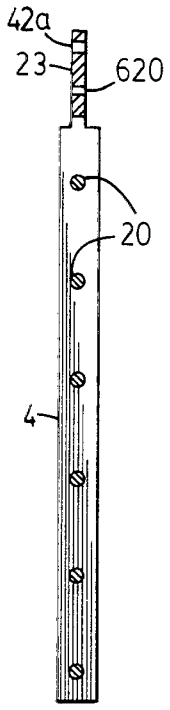
FIG. 5 is a section view taken on line 5—5 of FIG. 4.
Figure 6:
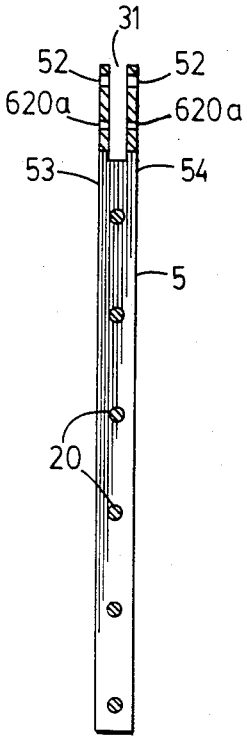
FIG. 6 is a section view taken on line 6—6 of FIG. 4.
Figure 7:
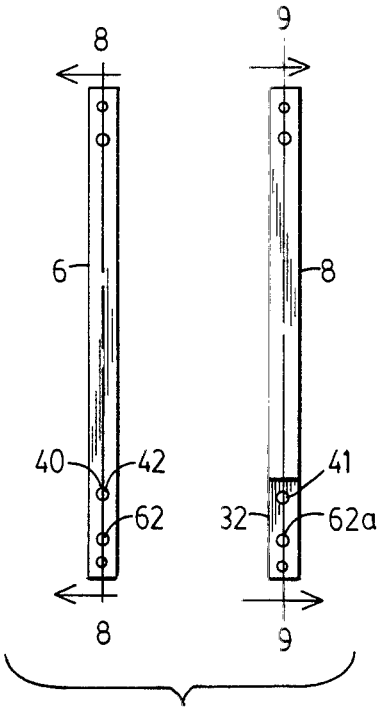
FIG. 7 is a front elevation view of the two side rails which make up the first hinged section of the ladder in accordance with this invention.
Figure 8:
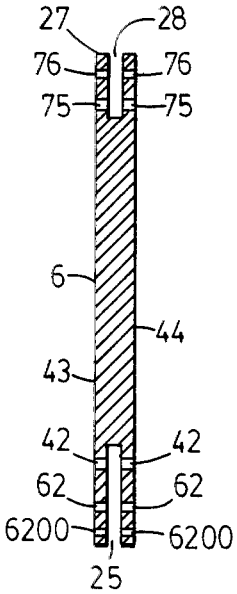
FIG. 8 is a section view taken on line 8—8 of FIG. 7.
Figure 9:
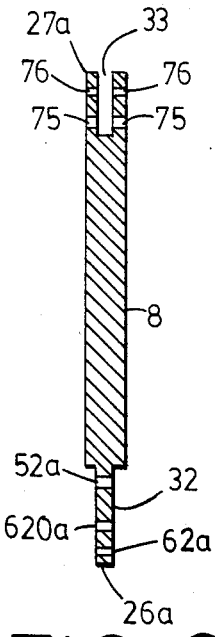
FIG. 9 is a section view taken on line 9—9 of FIG. 7.
Figure 10:
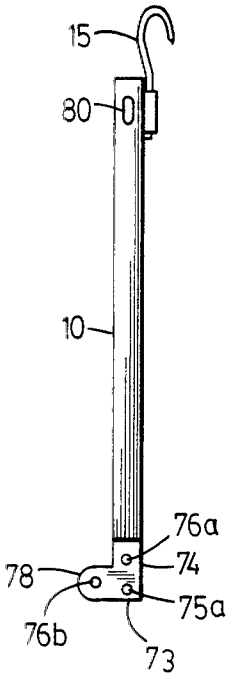
FIG. 10 is a front elevation view of one of the side rails which makes up the second hinged section or uppermost section of the ladder in accordance with this invention, specifically the one shown on the left in FIG. 1.
Figure 11:
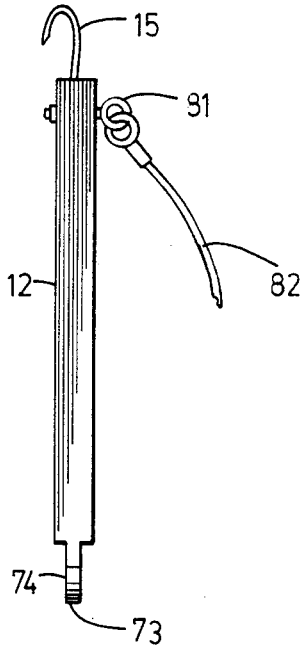
FIG. 11 is a side elevation view of the other side rail which makes up the second hinged section, or uppermost section, of the ladder in accordance with this invention, specifically the one shown on the right in FIG. 1.
Figure 12:
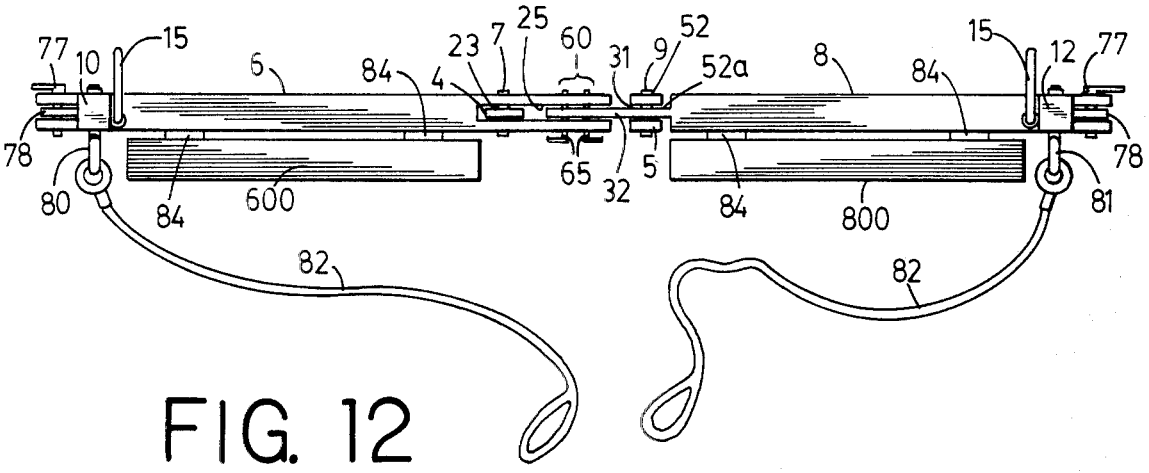
FIG. 12 is a plane view from above showing the ladder in accordance with this invention in the spread-apart position of its upper section.
Figure 13:
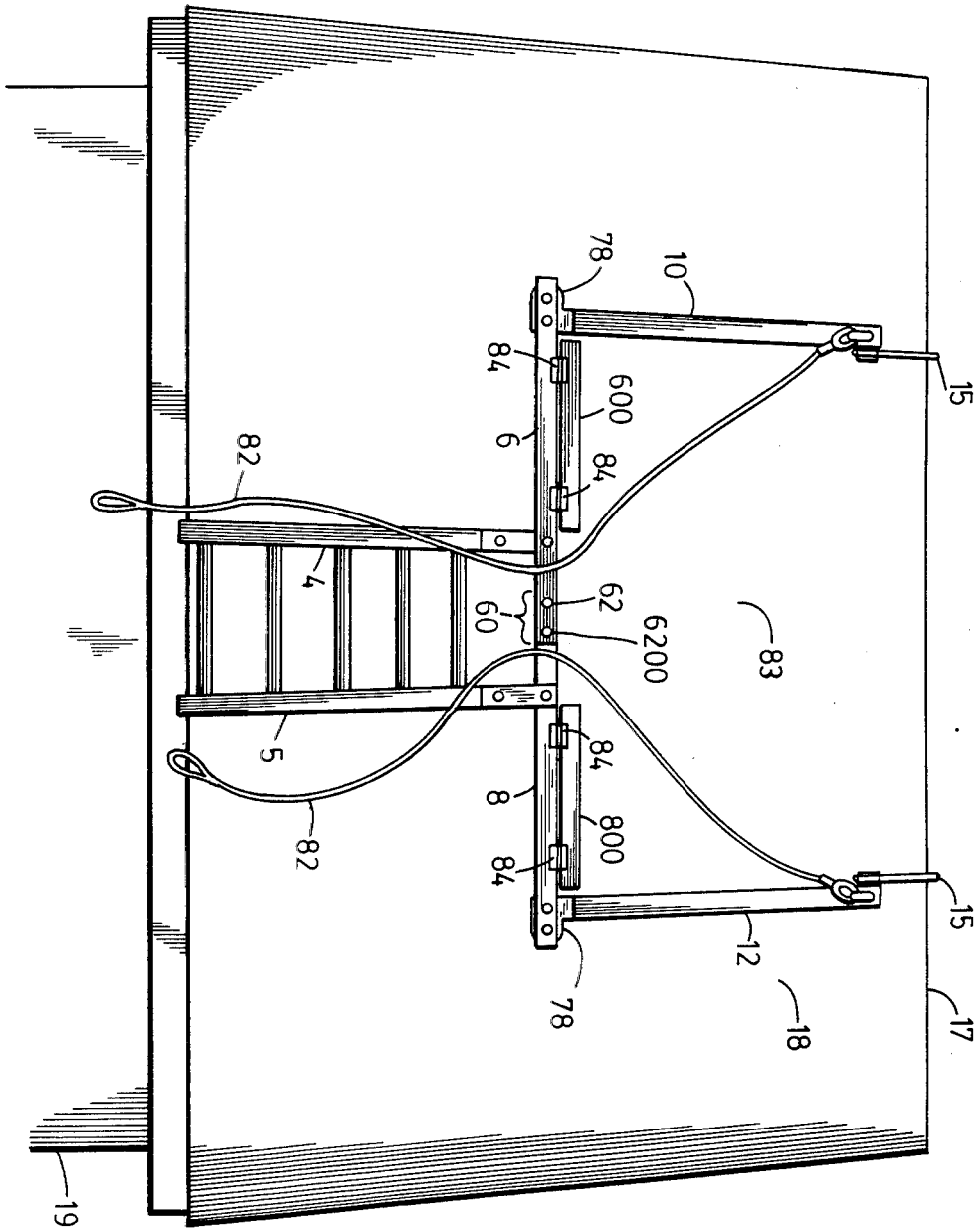
FIG. 13 is a side elevation view of the ladder in accordance with this invention shown on the roof of a house in the spread-apart position of its upper section, the hooks at the free end of the upper section shown over the peak of the roof to hold the ladder in place, showing the wide unobstructed clearance zone for the firefighter or other workman to perform whatever his task is on the roof between the spread-apart side rails of the upper section of the ladder.

A ladder in accordance with the present invention includes a first side rail assembly 2 and a second side rail assembly 3, each of which include hinged sections whereby the side rail assemblies 2 and 3 can be pivoted between an aligned or in-line position where the sections are straight and a spread-apart position in which the upper portion of the ladder is spread apart.

Side rail assembly 2 includes a bottom section 4, and side side rail assembly 3 includes a corresponding bottom section 5. Side rail assembly 2 includes a first hinged section 6 pivotally connected to its bottom section 4 by a hinge pin 7. Side rail assembly 3 includes a corresponding first hinged section 8 pivotally connected to its bottom section 5 by a hinge pin 9. Side rail assembly 2 includes a second hinged section 10 pivotally connected to its first hinged section 6 by a hinge pin 11. Side rail assembly 3 includes a corresponding second hinged section 12 pivotally connected to its first hinged section 8 by a hinge pin 13.

The upper free end 14 of the second hinged section 10 of side rail assembly 2 includes a hook 15 for anchoring the ladder at its upper end. The upper free end 16 of the second hinged section 12 of side rail assembly 3 includes a corresponding hook 15, both of said hooks 15 being provided to secure the upper end of the ladder to the peak 17 of a roof 18 of a house 19 or other anchoring means.

The bottom sections 4 and 5 of the side rail assemblies include a plurality of spaced apart rungs 20 extending laterally between their side walls 21 and 22, and normal thereto. The side walls 21 and 22 extend in spaced apart parallel planes.

Side wall 21 of bottom section 4 includes a tongue 23 extending upwardly at its upper end 24, received in a corresponding groove or recess 25 which opens to the lower end 26 of the first hinged section 6 of side rail assembly 2. The upper end 27 of first hinged section 6 includes a groove or recess 28 opening to that upper end 27 to receive a corresponding tongue 29 extending downwardly from the lower end 30 of the second hinged section 10 of side rail assembly 2.

Side wall 22 of bottom section 5 includes a groove or recess 31 which opens to its upper end **24*a*, to receive a corresponding tongue 32 extending downwardly from the lower end 26*a* of the first hinged section 8 of side rail assembly 3. The upper end 27*a* of first hinged section 8 includes a groove or recess 33 opening to that upper end 27*a* to receive a corresponding tongue 34 extending downwardly from the lower end 30*a* of the second hinged section 12 of side rail assembly 3**.

Each of the tongue and groove combinations includes hinge pins and corresponding hinge apertures for pivotal movement of the sections of the side rail assemblies 2 and 3 between the in-line position and the spread-apart position, and each tongue and groove combination also includes lock pins and corresponding lock apertures to secure the sections in each of the two positions when pivoted thereto. These hinge and lock pins and apertures, and their respective tongue and groove combinations are described as follows.

The tongue and groove combinations comprising tongue 23 of bottom sections 4 and groove 25 of first hinged section 6 of side rail assembly 2, and tongue 32 of first hinged section 8 and groove 31 of bottom section 5 of said rail assembly 3, are elongated in the longitudinal direction of the sections of which they are a part, their length being less than the distance the side wall 21 and 22 of the bottom sections 4 and 5 are spaced apart but greater than half such distance. Thus when the first hinged section 6 of side rail assembly 2 is pivoted outwardly from its bottom section 4 at a right angle thereto, the recess or groove 25 at the lower end 26 of the first hinged section 6 extends laterally across the space between bottom sections 4 and 5 at their respective upper ends 24 and **24*a* for a distance more than half the distance those bottom sections 4 and 5 are spaced apart. When the first hinged section 8 of side rail assembly 3 is pivoted outwardly in the opposite direction from its bottom section 5 at a right angle thereto, the tongue 32 at the lower end 26*a* of said first hinged section 8 extends laterally across the space between bottom section 4 and 5 at their respective upper ends 24 and 24*a* for a distance more than half the distance those bottom sections 4 and 5 are spaced apart. The tongue 32 extends laterally across said space in the direction toward side rail assembly 2, and the groove 25 extends laterally across said space in the opposite direction toward side rail assembly 3. The pivot point 40 of bottom section 4 and first hinge section 6 of said rail assembly 2, and the pivot point 41 of bottom section 5 and first section 8 of said rail assembly 3 are at the same distance from the bottom edge of their respective bottom sections 4 and 5, and such pivot points 40 and 41 lie in the same plane normal to the parallel spaced apart bottom sections 4 and 5. Thus, the groove 25 of the first hinged section of side rail assembly 2 receives the tongue 32 of the first hinged section 8 in mating and overlapping relationship when each of said first hinged sections 6 and 8 are pivoted to their respective outwardly extending right angle positions relative to thier respective bottom sections 4 and 5**.

Hinge aperatures 42 extend through the lower portion of first hinged section 6 at pivot point 40 from one end wall 43 to the opposite end wall 44 thereof, and hinge aperture **42*a* extends through the tongue 23 of bottom section 4 near its outer end portion also at pivot point 40. Hinge apertures 42 and 42*a* are in registration, and hinge pin 7 extends therethrough to pivotally join bottom section 4 and first hinged section 6 of side rail assembly 2**.

Hinge apertures 52 extend through the upper portion of bottom section 5 at pivot point 41 from one end wall 53 to the opposite end wall 54 thereof, and hinge aperture **52*a* extends through the tongue 32 of the first hinged section 8 near its inner end portion also at pivot point 41. Hinge apertures 52 and 52*a* are in registration, and hinge pin 9 extends therethrough to pivotally join bottom section 5 and first hinged section 8 of side rail assembly 3**.

When groove 25 of the first hinged section of side rail assembly 2 receives the tongue 32 of the first hinged section 8 of side rail assembly 3 as described above there is an overlapping zone 60 wherein the side walls of groove 25 lap and lie adjacent to the tongue 32. Lock apertures 62 extend through the lower end region of first hinged section 6 from one end wall 43 to the opposite end wall 44 thereof, and lock aperture **62*a* extends through the tongue 32 of the first hinged section 8 near its end portion so as to be in registration with apertures 62 when tongue 32 is received in groove 25. Lock pin 65 extend through apertures 62 and 62*a* to lock tongue 32 in the groove 25 and thereby lock the first hinged sections 6 and 8 in their oppositely outwardly extending positions at right angles to their respective bottom section 4 and 5**, that is their spread-apart position.

Additional lock apertures 620 and **620*a* are provided to lock the first hinged sections 6 and 8 in their in-line positions relative to their respective bottom sections 4 and 5. Aperture 620 is located at that point near the inner end of tongue 23 of bottom section 4 which is in registration with apertures 62 through the lower end region of first hinged section 6 when that section is aligned with bottom section 4 in the in-line position. A lock pin 65 is place through apertures 62 and 620 to lock bottom section 4 and first hinged section 6 of side rail assembly 2** in their in-line position.

Apertures **620*a* are located at a point near the upper portion of bottom section 5 which spans an inner region of its groove 31, and at the point thereof which is in registration with aperture 62*a* through the tongue 32 of first hinged section 8 when said tongue 32 is received in said groove 31 of bottom section 5. A lock pin 65 is place through apertures 62*a*** *l and* **620*a* to lock bottom section 5 and first hinged section 8 of side rail assembly 3** in their in-line position.

For more secure locking of the first hinged section 6 and 8 in their outwardly extending or spread-apart position wherein the tongue 32 of first hinged section 8 is received in the groove 25 of the first hinged section 6, additional locking apertures 6200 may be provided through the first hinged section 6 within the overlapping zone 60 but spaced apart from locking apertures 62, such locking apertures 6200 being at such time in registration with a corresponding locking apertures 6200*a* through the tongue 32 of first hinged section 8. A second lock pin 65 may be placed through the apertures 6200 and 6200*a* to supplement the locking strength of a first lock pin 65 through the apertures 62 and 62*a*.

The upper ends of first hinge sections 6 and 8 of side rail assemblies 2 and 3 include respective grooves 28 and 33 in the side walls 71 and 72 respectively of said first hinge sections 6 and 8, said grooves 28 and 33 opening to their respective upper ends 27 and 27*a*. The lower ends 73 of the second hinged sections 10 and 12 of side rail assemblies 2 and 3 include respective tongues 74 which are received in the grooves 28 and 33 when the first hinged sections 6 and 8 are in their in-line position with their respective second hinged sections 10 and 12. Hinge apertures 75 extend through the upper end portions of first hinge sections 6 and 8 at a point which spans the said grooves 28 and 33 near the inner end thereof, from one end wall 43 to the opposite end wall of said first hinge sections 6 and 8, and hinge apertures 75*a* extend through the respective tongues 74 of the second hinged sections 10 and 12 at points which are in registration with hinged apertures 75 which intersect the respective grooves 28 and 33 in the which the tongues 74 are received. Hinge pins 11 extend through the hinge apertures of the first and second hinged sections 6 and 10 of side rail assembly 2, and hinge pins 13 extend through the hinge apertures of the first and second hinged sections 8 and 12 of side rail assembly 3.

Locking apertures 76 also extend through the upper end portions of first hinge sections 6 and 8 at a point which spans the said grooves 28 and 33 near the outer ends thereof, from one end wall 43 to the opposite end wall 44 of said first hinge sections 6 and 8, and locking apertures 76*a* extend through the respective tongue 74 of the second hinged sections 10 and 12 at points which are in registration with locking apertures 76 which intersect the respective grooves 28 and 33 in which the tongues 74 are received when the first hinged sections 6 and 8 are in the in-line position. Lock pins 77 are placed through the lock apertures 76 and 76*a* when they are in registration to lock and hold the first hinged sections 6 and 8 in their in-line position with their respective second hinged sections 10 and 12.

When the first hinged sections 6 and 8 are pivoted to their spread apart position at right angles to their respective bottom sections 4 and 5, the lock pins 77 are removed from locking hinged sections 10 and 12 to be pivoted upwardly from and at right angles to their respective first hinged sections 6 and 8. The tongues 74 of the second hinged sections 10 and 12 include outwardly projecting enlarged portions 78 having locking apertures 76*b* therethrough. When the second hinged sections 10 and 12 are pivoted upwardly from and at right angles to their respective first hinged sections 6 and 8, the enlarged portions 78 of the tongues 74 are swung into the outer portions of the respective grooves 28 and 33 of the first hinged sections, and the locking apertures 76*b* through the enlarged portions 78 then come into registration with the locking apertures 76 through the upper ends of the first hinged sections 6 and 8. The lock pins 77 are placed through said locking apertures 76 and 76*b* to lock and hold the second hinged sections 10 and 12 in their upwardly extending positions at right angles to their respective first hinged sections 6 and 8.

In operation, the ladder 1 in accordance with this invention is first in its in-line position, and carried to a fire in that position. It is then pivoted to its spread-apart position by removing the lock pins 65 from the locking apertures 62 and 620 of the tongue and groove combination of the bottom section 4 and first hinged section 6 of side rail assembly 2, and from the locking aperture 62*a* and 620*a* of the tongue and groove combination of the bottom section 5 and first hinged section 8 of side rail assembly 3, then pivoting the first hinged section 6 and 8 outwardly to positions normal to or at right angles to their respective bottom sections 4 and 5. At such time the tongue 32 at the lower end of first hinged section 8 is received in the groove 25 at the lower end of first hinged section 6, and the locking apertures 62 through first hinged section 6 opening to its groove 25 and locking aperture 62*a* through the tongue 32 of first hinged section 8 are in registration. A lock pin 65 is then placed through such apertures to lock the outwardly extending first hinged sections 6 and 8 in that outwardly extending position. At this time the additional locking apertures 6200 and 6200*a* are also in registration, and an additional lock pin 65 is placed through such apertures to more securely lock the first hinged sections 6 and 8 in the outwardly extending position.

The lock pins 77 are then removed from locking apertures 76 at the upper ends of the first sections 6 and 8 and the corresponding locking apertures 76*a* which extend through the tongues 74 of the second hinged sections 10 and 12. The second hinged sections 10 and 12 are then pivoted upwardly from their respective first hinged sections 6 and 8 until they are normal thereto, or at right angles thereto. At such time, the locking apertures 76*b* through the enlarged portions of the tongues 74 of the second hinged sections 10 and 12 come into registration with the locking apertures 76 through the upper portions of the first hinged sections 6 and 8. The lock pins 77 are then placed through such apertures 76*b* to lock the second hinged sections 10 and 12 in their upwardly extending position at substantially right angles to their respective first hinged sections 6 and 8.

The ladder 1 is now locked in its spread apart position ready for use on the roof of the burning building. A firefighter uses a conventional extension ladder to climb to the edge of the roof 18 of the burning house 19, carrying the spread-apart ladder 1 of the present invention with him. This ladder 1 is then pushed up on to the roof until the hooks 15 and 16 at the free ends of the second hinged sections 10 and 12 hook over the peak 17 of the roof 18.

Eyebolts 80 and 81 are provided through the upper ends of the second hinged sections 10 and 12 through which respective ends of lifelines 82 are secured, the other ends of which are secured to the firefighter when he climbs on to the roof 18. The firefighter climbs the rungs 20 of the bottom section of the ladder 1 until he reaches the top of that section, whereupon he can then stand on the horizontally extending first hinged sections 6 and 8. He is now in a position where he can use an axe to chop a hole in the roof 18 near the peak 17. The hole should preferably be about three feet by five feet. The length of the first and second hinged sections to provide a clearance zone 83 of the size necessary for making a 3 foot by 5 foot hole is preferably about two feet to three feet in length for the first hinged sections 6 and 8, and about four feet to six feet in length for the second hinged sections 10 and 12.

Hinged platform rails 600 and 800 may be provided along the respective first hinged section 6 and 8, connected along the side edges thereof by hinge members 84, and pivotable between a folded position wherein platform rail 600 overlies the first hinged section 6 and the platform rail 800 overlies the first hinged section 8, and an unfolded or working position wherein platform rail 600 lies outward of and alongside of first hinged section 6 and platform rail 800 lies outward of and alongside of first hinged section 8, thereby providing a wider platform or step for the firefighter to stand on as he is working on the roof.

When the work is completed, the locking pins 65 and 77 are removed to pivot the side rail assemblies 2 and 3 back to their in-line position, whereupon the locking pins 65 and 77 are then placed in the aforesaid locking apertures which hold the ladder 1 in its in-line position.

The clearance zone 83 between the second hinged sections 10 and 12 and above the first hinged sections 6 and 8 when in the spread-apart position as described is completely unobstructed. It provides a completely open working area for firefighters, and also for other workman such as roofers for whom it is convenient to have a large unobstructed clearance zone between the side rails of a ladder in which to work, and a widened horizontally extending platform or base on which to stand as such work is being done.

I claim:

1. A ladder comprising a lower section and an upper section, said upper section including a first side rail along one side of said ladder and a second side rail along the other side of said ladder, expanding means to move said first and second side rails between a first position wherein they are relatively close together and a second position wherein they are farther apart, including an unobstructed clearance zone between said first and second side rails when in said second position, wherein said lower section of said ladder includes a first lower section side rail along one side of said ladder and a second lower section side rail along the other side of said ladder, said expanding means including pivot connecting means to pivotally connect said first lower section side rail to said first side rail of said upper section and to pivotally connect said second lower section side rail to said second side rail of said upper section, including a first platform rail hingedly connected to said first intermediate rail and pivotable between a position overlapping said first intermediate rail and a position alongside said first intermediate rail, and a second platform rail hingedly connected to said second intermediate rail and pivotable between a position overlapping said second intermediate rail and a position alongside said second intermediate rail, said intermediate rails being pivotable to a horizontal position when said lower section side rails are vertical, said platform rails being pivoted to said alongside position for use as a platform for a workman when said intermediate rails are in said horizontal position.

2. A ladder comprising a lower section and an upper section, said upper section including a first side rail along one side of said ladder and a second side rail along the other side of said ladder, expanding means to move said first and second side rails between a first position wherein they are relatively close together and a second position wherein they are farther apart, including an unobstructed clearance zone between said first and second side rails when in said second position, wherein said lower section of said ladder includes a first lower section side rail along one side of said ladder and a second lower section side rail along the other side of said ladder, said expanding means including pivot connecting means to pivotally connect said first lower section side rail to said first side rail of said upper section and to pivotally connect said second lower section side rail to said second side rail of said upper section.

3. A ladder as set forth in claim 2, wherein said pivot connecting means includes a first intermediate rail pivotally connected at one end to said first lower section side rail and pivotally connected at its opposite end to said first side rail of said upper section, and a second intermediate rail pivotally connected at one end to said second lower section side rail and pivotally connected at its opposite end to said second side rail of said upper section.

4. A ladder as set forth in claim 3, including lock means to releasably lock said ladder in both said first position wherein said side rails of said upper section are relatively close together and said second position wherein they are farther apart.

5. A ladder as set forth in claim 4, wherein said first intermediate rail is pivotable between a first in-line position with said first lower section side rail and a second position substantially normal thereto, said second intermediate rail is pivotable between a first in-line position with said second lower section side rail and a second position substantially normal thereto, said lock means including means to hold said first intermediate rail and said first lower section side rail against substantial movement of one relative to the other when in said first position and when in said second position, and means to hold said second intermediate rail and said second lower section side rail against substantial movement of one relative to the other when in said first position and when in said second position.

6. A ladder as set forth in claim 5, wherein said first intermediate rail is pivotable between a first in-line position with said first side rail of said upper section and a second position substantially normal thereto, said second intermediate rail is pivotable between a first in-line position with said second side rail of said upper section and a second position substantially normal thereto, said lock means including means to hold said first intermediate rail and said first side rail of rail of said upper section against substantial movement of one relative to the other when in said first position and when in said second position, and means to hold said second intermediate rail and said second side rail of said upper section against substantial movement of one relative to the other when in said first position and when in said second position.

7. A ladder as set forth in claim 6, wherein said pivotally connected ends of said first intermediate rail and said first lower section side rail include a first tongue and groove combination, said pivotally connected ends of said second intermediate rail and said second lower section side rail include a second tongue and groove combination, said tongues being fully received in said grooves when said rails are in said first in-line position, said first intermediate rail extending outwardly laterally in one direction from said first lower section side rail when in said second position substantially normal to each other, said second intermediate rail extending outwardly laterally in the opposite direction from said second lower section side rail when in said second position substantially normal to each other, the tongue of said first tongue and groove combination being at such time pivoted to extend inwardly from the rails to which it is pivotally connected toward the other rails to which the said second tongue and groove combinations is pivotally connected, the groove of said second tongue and groove combination being at such time pivoted to extend inwardly from the rails to which it is pivotally connected toward the other rails to which the said first tongue and groove combination is pivotally connected, said tongue of said first tongue and groove combination being received in said groove of said second tongue and groove combination, a portion of said tongue being thereby overlapped by a portion of said groove.

8. A ladder as set forth in claim 7, wherein said lock means includes first holding means to hold said tongue of said first tongue and groove combination in said groove of said second tongue and groove combination to thereby hold each pair of said pivotally connected rails in said second position wherein the rails of each pair are substantially normal to each other.

9. A ladder as set forth in claim 8, wherein said first holding means includes a lock aperture extending through said overlapped portion of said tongue of said first tongue and groove combination and said groove of said second tongue and groove combination, and a lock pin through said lock aperture to prevent said tongue from moving out of said groove until said lock pin is removed.

10. A ladder as set forth in claim 9, wherein said pivotally connected ends of said first intermediate rail and said first side rail of said upper section include a third tongue and groove combination, said pivotally connected ends of said second intermediate rail and said second side rail of said upper section include a fourth tongue and groove combination, said tongues being fully received in said grooves when said rails are in said first in-line position, said first side rail of said upper section extending upwardly from said first intermediate rail in a direction away from said lower section side rails when in said second position substantially normal to each other, said second side rail of said upper section extending upwardly from said second intermediate rail in a direction away from said lower section side rails when in said second position substantially normal to each other, the tongues of said third and fourth tongue and groove combinations being at such time pivoted to extend perpendicular through the corresponding grooves thereof, said lock means including second holding means to hold said tongues in such position relative to said corresponding grooves.

11. A ladder as set forth in claim 10, wherein said second holding means includes a first lock aperture intersecting the groove of said third tongue and groove combination at a point outboard of the perpendicular extending tongue thereof and closely adjacent thereto, a first lock pin through said first lock aperture to bear against said tongue to prevent pivotal movement of said first side rail of said upper section back to said first in-line position relative to said first intermediate rail, a second lock aperture intersecting the groove of said fourth tongue and groove combination at a point outboard of the perpendicularly extending tongue thereof and closely adjacent thereto, a second lock pin through said second lock aperture to bear against said tongue to prevent pivotal movement of said second side rail of said upper section back to said first in-line position relative to said second intermediate rail.

12. A ladder as set forth in claim 11, wherein the tongues of said third and fourth tongue and groove combinations include an enlarged portion outboard thereof when said tongues are in said position extending perpendicular through said corresponding grooves, a lock aperture through said enlarged porition of each of said tongues of said third and fourth tongue and groove combinations, said lock apertures through said enlarged portions being in registration with respective corresponding ones of said first and second lock apertures which intersect respective grooves of said third and fourth tongue and groove combinations when said side rails of said upper section are in said second position substantially normal to their respective intermediate rails to which they are respectively connected, said first and second lock pins thereby extending through respective ones of said lock apertures through said enlarged portions of said tongues when they are placed through their respective first and second lock apertures.

13. A ladder as set forth in claim 3, including a first hook projecting outwardly from the outer free end of said first side rail of said upper section, and a second hook projecting outwardly from the outer free end of said second side rail of said upper section.

14. A ladder as set forth in claim 13, including safety lines connected to said outer free ends of said first and second side rails of said upper section.

* * * * *